US007282702B2

(12) United States Patent
Jeon et al.

(10) Patent No.: US 7,282,702 B2
(45) Date of Patent: Oct. 16, 2007

(54) ION NEUTRALIZER

(75) Inventors: Yun Kwang Jeon, Seoul (KR); Jung Wook Kim, Seongnam-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 222 days.

(21) Appl. No.: 11/174,571

(22) Filed: Jul. 6, 2005

(65) Prior Publication Data

US 2006/0163464 A1 Jul. 27, 2006

(30) Foreign Application Priority Data

Jan. 27, 2005 (KR) ..... 10-2005-0007667

(51) Int. Cl.
*H05H 3/02* (2006.01)

(52) U.S. Cl. ..... 250/251; 250/489; 250/492.21; 250/398; 250/492.2; 313/359.1; 313/359

(58) Field of Classification Search ..... None
See application file for complete search history.

(56) References Cited

U.S. PATENT DOCUMENTS 4,662,977 A * 5/1987 Motley et al. ..... 156/345.49
6,515,408 B1 2/2003 England et al.
2004/0016876 A1* 1/2004 Yeom et al. ..... 250/251
2006/0163466 A1* 7/2006 Park et al. ..... 250/251
2006/0219887 A1* 10/2006 Hwang et al. ..... 250/251

FOREIGN PATENT DOCUMENTS

KR 2001-102628 11/2001
KR 2004-33524 A 4/2004

* cited by examiner

*Primary Examiner*—Jack I. Berman
*Assistant Examiner*—Zia R. Hashmi
(74) *Attorney, Agent, or Firm*—Stanzione & Kim, LLP

(57) ABSTRACT

An ion neutralizer enhances a heat transfer rate between a reflecting plate and a frame while preventing the reflecting plate from being bent due to thermal deformation. The ion neutralizer includes a frame and a plurality of reflecting plates integrally formed with the frame to neutralize plasma ions. Each reflecting plate has a cantilever shape. Each reflecting plate has a supporting end in surface contact with the frame, and a free end to define a space with the frame in order to prevent the reflecting plate from being bent upon stretching due to thermal deformation.

20 Claims, 5 Drawing Sheets

ION NEUTRALIZER

CROSS-REFERENCE TO RELATED APPLICATIONS

This application claims the benefit of Korean Patent Application No. 2005-7667, filed on Jan. 27, 2005 in the Korean Intellectual Property Office, the disclosure of which is incorporated herein by reference.

BACKGROUND OF THE INVENTION

1. Field of the Invention

The present general inventive concept relates to an ion neutralizer, and, more particularly, to an ion neutralizer comprising a reflection plate to neutralize plasma ions in a semiconductor processing plasma apparatus.

2. Description of the Related Art

In semiconductor processing, plasma has been widely used for various unit processes, such as physical or chemical vapor deposition, photosensitive agent cleaning, and other surface processes. According to demands on high integration of a semiconductor device and an increase in a wafer diameter or area, requirements for an apparatus for processing an object also become strict, which is the same as those for plasma equipment. In an attempt to enhance performance of the plasma equipment, it has been developed for the plasma equipment to perform high speed processing by increasing a density of the plasma within a chamber, or to perform processing of an object having a large area by providing uniform plasma distribution. For example, a density of the plasma can be increased by inductively coupled plasma equipment, and the uniform plasma distribution can be provided by displacement of an antenna or variation of introducing location of reactant gas.

However, in spite of the above attempt, the plasma processing has a limitation in performing super accuracy processing of wafers. For example, if charged plasma ions are used for an etching process, an object of the etching process can also be charged during the etching process, thereby changing an etching profile or creating a voltage gradient and causing damage to a diode formed on the object. Meanwhile, when accelerated plasma ions are used for the etching process, dislocations or deformed skin layers can be formed on a surface of a substrate. In order to solve these problems, energy of the plasma ions must be lowered, or additional heat treatment must be performed to restore the damaged surface of the object after the etching process.

In order to solve the disadvantages of the plasma processing as described above, U.S. Pat. No. 4,662,977 discloses a method using neutralized particles instead of the plasma ions in a conventional ion neutralizer. According to the disclosure, the plasma ions generated from a plasma generator are transformed into the neutralized particles after being reflected by heavy metal plates, so that the neutralized particles are used for processing an object. Processing equipment using the above method requires an ion neutralizer for neutralizing the plasma ions. However, the conventional ion neutralizer has various disadvantages, and thus the disadvantages of the conventional ion neutralizer should be overcome to improve the plasma processing.

The conventional ion neutralizer has a construction as follows.

The conventional ion neutralizer comprises a ring-shaped frame defining an outer periphery of the ion neutralizer, and a plurality of reflecting plates arranged in parallel inside the frame. The frame is formed with a refrigerant path for cooling heat generated upon impact of plasma ions, and a plurality of slots for inserting the reflection plates within a diameter of the frame. Each reflecting plate is inserted at both ends thereof into the slots, and fixed thereto. When the plasma ions collide with the reflecting plates, the plasma ions are subjected to charge exchange, and are then transformed into neutralized particles.

When the plasma ions collide with the reflecting plates, heat of the plasma ions is transferred to the reflecting plates, increasing a temperature of the reflecting plates. The heat is transferred to the frame, and is then finally discharged to an outside thereof via the refrigerant passing through the refrigerant path in the frame. Meanwhile, if the heat transfer between the reflecting plates and the frame is not smoothly performed, the reflecting plates have a remarkably increased temperature, and are subjected to thermal deformation, causing the reflecting plates to be bent. When the reflection plates are bent, a direction of the neutralized particles reflected by the reflection plates is deviated from a designed direction, negatively influencing the result of the process.

In the conventional ion neutralizer, since the frame and the reflecting plates are provided by machining metallic materials, some degree of surface roughness is necessarily formed on the surfaces of the frame and the reflecting plates, so that when the reflecting plates are inserted into the slots of the frame, a plurality of point contacts are created between the reflecting plates and the frame. As a result, since the heat transfer between the reflecting plates and the frame is mainly carried out through these point contacts, a heat transfer rate is remarkably lowered. Particularly, since the interior of the plasma equipment where the ion neutralizer is installed is generally in a vacuum state, there are no media, which can improve the heat transfer between the reflecting plates and the frame, thereby deteriorating a heat transfer rate therebetween.

SUMMARY OF THE INVENTION

In order to solve the foregoing and/or other problems, the present general inventive concept provides an ion neutralizer designed to enhance a heat transfer rate between a reflecting plate and a frame while preventing the reflecting plate from being bent due to thermal deformation.

Additional aspects and/or advantages of the general inventive concept will be set forth in part in the description which follows and, in part, will be obvious from the description, or may be learned by practice of the general inventive concept.

The foregoing and/or other aspects and advantages of the present general inventive concept may be accomplished by providing an ion neutralizer comprising a frame and a plurality of reflecting plates integrally formed with the frame to neutralize plasma ions. Each reflecting plate may have a cantilever shape. Each reflecting plate may have a supporting end to be in surface contact with the frame, and a free end to define a space with the frame in order to prevent the reflecting plate from being bent upon stretching due to thermal deformation.

The plurality of reflecting plates may be arranged such that the supporting end of one of the reflecting plates and the free end of the other reflecting plate are alternately arranged. For this purpose, the frame may be formed with a labyrinthine groove by wire-cut electrical discharging machining.

The frame may have a path formed therein, and a refrigerant circulates along the path.

The foregoing and/or other aspects and advantages of the present general inventive concept may be accomplished by providing an ion neutralizer comprising a frame, and a plurality of reflecting plates in surface contact with the frame to neutralize plasma ions. A space may be formed between the frame and the reflecting plate in order to prevent the reflecting plates from being bent upon stretching due to thermal deformation.

The reflecting plates may be integrally formed with the frame, and the frame may be formed with a labyrinthine groove to form the reflecting plates.

BRIEF DESCRIPTION OF THE DRAWINGS

These and/or other aspects and advantages of the general inventive concept will become apparent and more readily appreciated from the following description of the embodiments, taken in conjunction with the accompanying drawings, of which.

DETAILED DESCRIPTION OF THE PREFERRED EMBODIMENTS

Reference will now be made in detail to the embodiments of the present general inventive concept, examples of which are illustrated in the accompanying drawings. The embodiments are described below to explain the present invention by referring to the figures.

Figure 1:
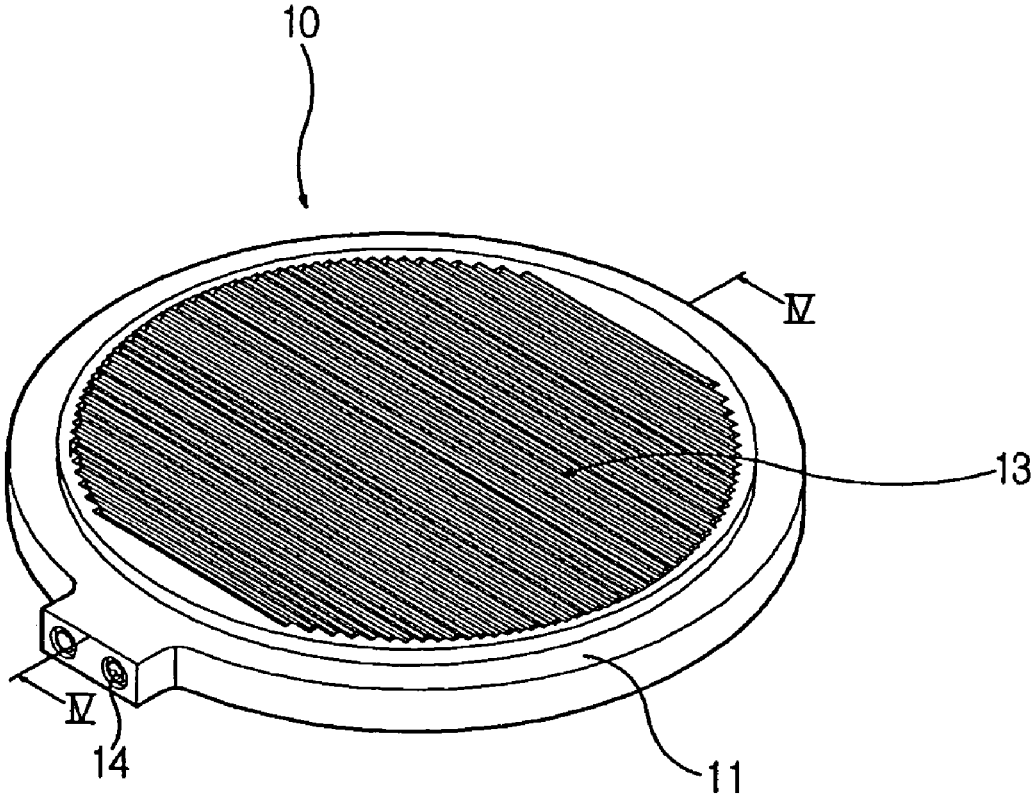
FIG. 1 is a perspective view illustrating an ion neutralizer according to an embodiment of the present general inventive concept.
Figure 2:
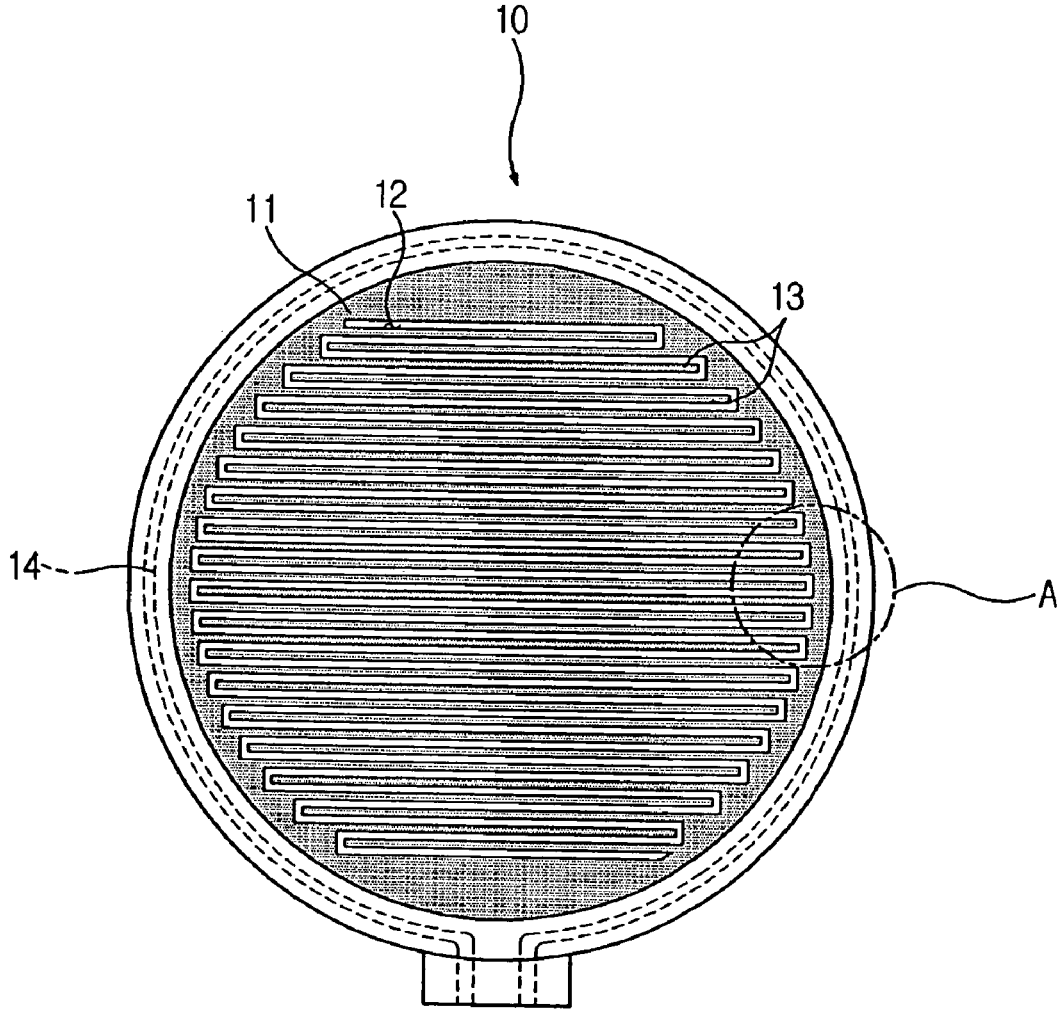
FIG. 2 is a top view illustrating the ion neutralizer of FIG. 1.

Referring to FIGS. 1 and 2, an ion neutralizer 10 according to an embodiment of the present general inventive concept comprises a disk-shaped frame 11 and a plurality of reflecting plates 13 integrally formed with the frame 11. A refrigerant path 14 to radiate heat transferred from the reflecting plates 13 is formed around a rim of the frame 11, and a refrigerant, such as water and ethylene glycol, circulates along the refrigerant path 14.

Figure 3:
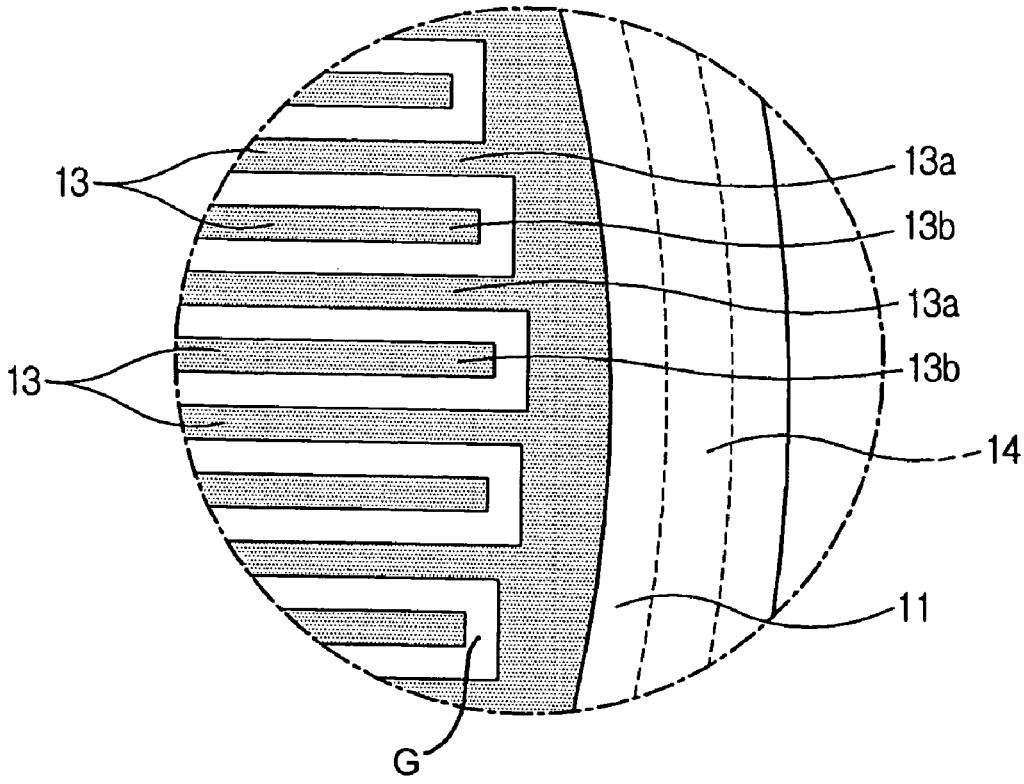
FIG. 3 is an enlarged view of a portion A of FIG. 2.

The plurality of reflecting plates 13 are arranged in parallel to each other, and have a typical cantilever shape. The cantilever-shaped reflecting plates 13, each having a supporting end 13*a* and a free end 13*b* as shown in FIG. 3, are arranged such that the supporting end 13*a* of one of the reflecting plates and the free end 13*b* of the other reflecting plate are alternately arranged. Such an arrangement is allowed by forming a labyrinthine groove 12 in the disk-shaped frame 11, and provides uniformly distributing of a load of the reflecting plates 13 to both sides of the frame 11.

Referring to FIG. 3, heat generated from the reflecting plates 13 is transferred to the frame 11 through the supporting ends 13*a* of the reflecting plates 13, and is then finally discharged to an outside of the ion neutralizer 10 via the refrigerant passing through the refrigerant path 14 in the frame 11. Since the reflecting plates 13 are integrally formed to the frame 11, each of the reflecting plates 13 is in face contact with the frame 11 at the supporting end 13*a* thereof. Accordingly, in comparison to the conventional ion neutralizer, the ion neutralizer 10 according to an embodiment of the present general inventive concept has a remarkably increased heat transfer area. Additionally, since the groove is formed around the free end 13*b* of each reflecting plate 13, a space G is ensured between the frame 11 and each reflecting plate 13. The space G can sufficiently be defined to ensure that the free end 13*b* does not contact the frame 11 even if the reflecting plate 13 is stretched due to the heat.

Figure 4:
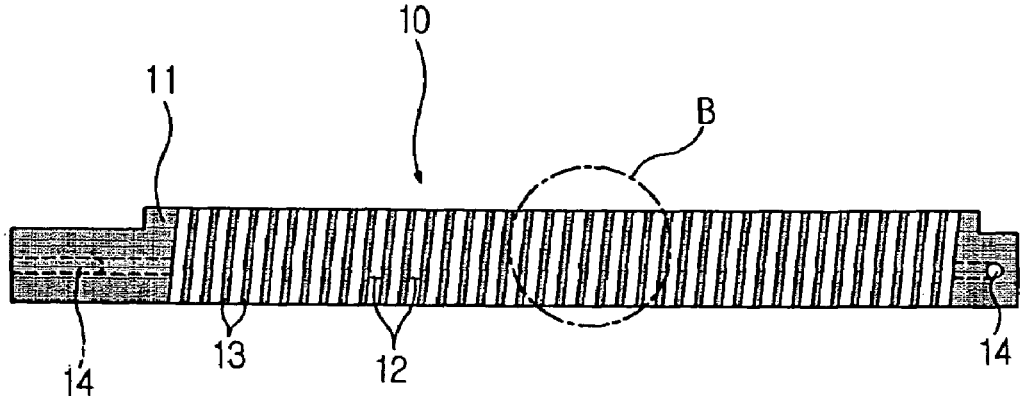
FIG. 4 is a cross-sectional view taken along a line IV-IV of FIG. 1.
Figure 5:
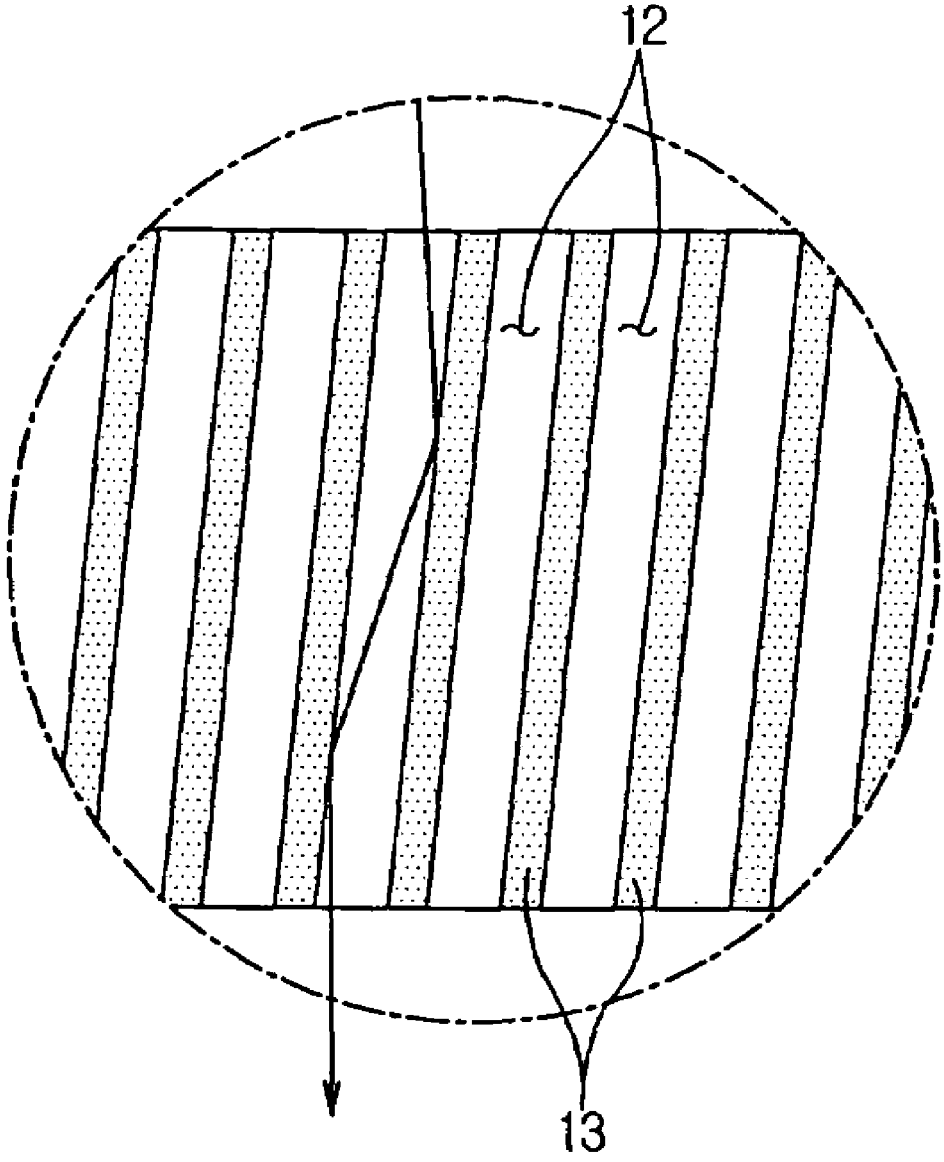
FIG. 5 is an enlarged view of a portion B of FIG. 4.

Referring to FIGS. 4 and 5, the reflecting plates 13 are inclined at a predetermined angle with respect to a line perpendicular to a major plane of the frame 11, which may be disposed on the refrigerant path 14, so that plasma ions incident to the ion neutralizer 10 can easily collide with the adjacent reflecting plates 13. The plasma ions collide with the reflecting plates 13 one or more times and are subjected to charge exchange with the reflecting plates 13, so that the plasma ions can be transformed into neutralized particles during the collision with the reflecting plates 13. An arrow shown in FIG. 5 illustrates a moving course of the plasma ions between the reflecting plates 13.

The ion neutralizer 10 of this embodiment can be made from a heavy metallic material, such as stainless steel. Alternatively, the ion neutralizer 10 may be made from materials, such as Ta, Mo, W, Au, Pt, and the like, or produced during coating such materials on an object. In the ion neutralizer 10 made of such metallic materials, the labyrinthine groove 12 may be formed in the frame 11 by wire-cut electrical discharging machining. The frame 11 may be formed with a disc-shaped plate and a rim formed in a circular shape around the disc-shaped plate. Since the labyrinthine groove 12 may be a single groove formed in the disc-shaped plate to form the reflecting plates 13, and the reflecting plates 13 is formed with the frame 11 in a monolithic single body, there is no disconnection or point-contact between the supporting ends 13*a* of the reflecting plates and the frame 11 for an effective heat exchange. The refrigerant path 14 is formed in the rim of the frame so that the refrigerant passes around the reflecting plates 13 to discharge heat from the reflecting plates 13 to an outside of the frame 11. The frame 11 has a first side and a second side defined with respect to a center portion thereof, and the supporting ends 13*a* of the reflecting plates 13 are extended from one of the first side and the second side so that the free ends 13*b* of the reflecting plates 13 are disposed toward the other one of the first side and the second side. That is, the reflecting plates 13 include a group of first reflecting plates and a group of second reflecting plates formed in a monolithic integral body with the disc-shaped plate and rim of the frame. The first reflecting plates are extended from the first side toward the second side while the second reflecting plates are extended from the second side toward the first side. The first reflecting plates and the second reflecting plates are disposed alternatively. Each of the first reflecting plates is disposed between the adjacent second reflecting plates. The groove may be defined by a first groove surface and a second groove surface, and the reflecting plates 13 may comprise a first reflecting plate defined by the first groove surface and a second reflecting plate defined by the second groove surface.

As described above, the ion neutralizer of the invention comprises the reflecting plates integrally formed to the frame such that the supporting ends of the reflecting plates are in surface contact with the frame, thereby providing a remarkably enhanced heat transfer rate.

Additionally, the free ends of the reflecting plates are separated from the frame, thereby preventing the reflecting plates from being bent even if the reflecting plates are stretched due to heat transfer.

Although exemplary embodiments of the general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An ion neutralizer comprising:

a frame; and a plurality of reflecting plates integrally formed with the frame to neutralize plasma ions.

2. The ion neutralizer according to claim 1, wherein each reflecting plate has a cantilever shape.

3. The ion neutralizer according to claim 2, wherein each reflecting plate comprises a supporting end in surface contact with the frame, and a free end to define a space with the frame in order to prevent the reflecting plate from being bent upon stretching due to thermal deformation.

4. The ion neutralizer according to claim 3, wherein the plurality of reflecting plates are arranged such that the supporting end of one of the reflecting plates and the free end of the other reflecting plate are alternately arranged.

5. The ion neutralizer according to claim 4, wherein the frame comprises a labyrinthine groove to form the plurality of reflecting plates.

6. The ion neutralizer according to claim 5, wherein the groove is formed by wire-cut electrical discharging machining.

7. The ion neutralizer according to claim 1, wherein the frame comprises a path formed therearound so that a refrigerant circulates therein.

8. An ion neutralizer comprising:

a frame; and one or more reflecting plates in surface contact with the frame to neutralize plasma ions.

9. The ion neutralizer according to claim 8, wherein a space is formed between the frame and the one or more reflecting plates in order to prevent the one or more reflecting plates from being bent upon stretching due to thermal deformation.

10. The ion neutralizer according to claim 9, wherein the reflecting plate is integrally formed with the frame, and the frame comprises a labyrinthine groove to define the one or more reflecting plates.

11. An ion neutralizer comprising:

a frame having a plate and a rim disposed around the plate: and at least one groove formed in the plate to define one or more reflecting plates to neutralize plasma ions, wherein the one or more reflecting plates and the plate of the frame are formed in a monolithic body.

12. The ion neutralizer according to claim 11, wherein the plate, the rim, and the one or more reflecting plates are formed in the monolithic body.

13. The ion neutralizer according to claim 11, wherein the at least one groove comprises a first groove surface and a second groove surface, and the one or more reflecting plates comprise a first reflecting plate defined by the first groove surface and a second reflecting plate defined by the second groove surface.

14. The ion neutralizer according to claim 11, wherein the at least one groove comprises a first groove surface and a second groove disposed to face the first groove, and the one or more reflecting plates comprise first reflecting plates defined by the first groove surface and second reflecting plates defined by the second groove surface.

15. The ion neutralizer according to claim 14, wherein the at least one groove comprises middle surfaces to connect end portions of the first and second groove surfaces.

16. The ion neutralizer according to claim 14, wherein the first groove surface and the second groove surface are spaced-apart from each other by a predetermined distance.

17. The ion neutralizer according to claim 11, wherein the plate comprises a first side and a second side disposed with respect to a center portion thereof, and the one or more reflecting plates comprise first reflecting plates extended from the first side toward the second side and second reflecting plates extended from the second side toward the first side.

18. The ion neutralizer according to claim 17, wherein each of the first reflecting plates is disposed between the adjacent second reflecting plates.

19. The ion neutralizer according to claim 11, wherein the plate comprises a first side and a second side disposed opposite to each other with respect to a center portion thereof, and the one or more reflecting plates comprise a first reflecting plate having a first support end formed on the first side and a first free end extended from the first support end toward the second side, and a second reflecting plate having a second support end formed on the second side and a second free end extended from the second support end toward the first side.

20. The ion neutralizer according to claim 19, wherein the first support end of the first reflecting plate is disposed adjacent to the second free end of the second reflecting plate, and the second support end of the second reflecting plate is disposed adjacent to the first free end of the first reflecting plate.

* * * * *